US008729784B2

(12) United States Patent
Rohrbach et al.

(10) Patent No.: US 8,729,784 B2
(45) Date of Patent: May 20, 2014

(54) FOULING RESISTANT SPARK PLUG

(71) Applicant: Fram Group IP LLC, Lake Forest, IL (US)

(72) Inventors: Ronald P. Rohrbach, Flemington, NJ (US); Peter D. Unger, Morristown, NJ (US); Jeffrey T. Boehler, Holland, OH (US); Jing Zheng, Findlay, OH (US)

(73) Assignee: Fram Group IP LLC, Lake Forest, IL (US)

( * ) Notice: Subject to any disclaimer, the term of this patent is extended or adjusted under 35 U.S.C. 154(b) by 0 days.

(21) Appl. No.: 13/766,103

(22) Filed: Feb. 13, 2013

(65) Prior Publication Data

US 2013/0214672 A1 Aug. 22, 2013

Related U.S. Application Data

(60) Provisional application No. 61/600,075, filed on Feb. 17, 2012.

(51) Int. Cl.
*H01T 13/20* (2006.01)

(52) U.S. Cl.
USPC ..... 313/143; 313/144; 313/145; 123/169 R

(58) Field of Classification Search
USPC ..... 313/118–145; 123/169 R, 169 EL, 32, 123/41, 310
See application file for complete search history.

(56) References Cited

U.S. PATENT DOCUMENTS

| | | | | |
|---|---|---|---|---|
| 4,092,264 | A | 5/1978 | Tsang et al. | |
| 4,267,483 | A | 5/1981 | Nakajima et al. | |
| 4,415,828 | A | 11/1983 | Mizuno et al. | |
| 5,109,178 | A | 4/1992 | Yoshida et al. | |
| 5,274,298 | A | 12/1993 | Cassidy et al. | |
| 5,550,424 | A | 8/1996 | Jennrich et al. | |
| 5,952,769 | A | 9/1999 | Budaragin | |
| 6,051,529 | A | 4/2000 | Brezny | |
| 6,060,821 | A | 5/2000 | Suzuki et al. | |
| 6,090,191 | A | 7/2000 | Atlanova | |
| 6,548,944 | B1 | 4/2003 | Morita | |
| 6,589,900 | B1 | 7/2003 | Kotze | |
| 6,858,975 | B1 | 2/2005 | Matsutani | |
| 6,888,293 | B2 | 5/2005 | Roessler et al. | |
| 2004/0066126 | A1 * | 4/2004 | Geier et al. | 313/143 |
| 2009/0189506 | A1 * | 7/2009 | Below | 313/143 |
| 2012/0326591 | A1 * | 12/2012 | Schenk et al. | 313/141 |
| 2013/0300278 | A1 * | 11/2013 | Rohrbach et al. | 313/141 |

* cited by examiner

*Primary Examiner* — Tracie Y Green
(74) *Attorney, Agent, or Firm* — Erin J. Fox; Barnes & Thornburg LLP

(57) ABSTRACT

An insulator for a spark plug is provided having an insulator tip. The insulator tip includes a feature extending radially inward from an exterior surface of the insulator tip.

20 Claims, 4 Drawing Sheets

FOULING RESISTANT SPARK PLUG

CROSS-REFERENCE

This application claims the benefit of U.S. Provisional Patent Application No. 61/600,075, filed Feb. 17, 2012, and entitled "Fouling Resistant Spark Plug," the entire disclosure of which is incorporated herein.

BACKGROUND

The subject matter disclosed herein relates to a spark plug and, in particular, to an insulator of a spark plug.

Spark plugs used as igniters in an internal combustion engine are subjected to a condition known as "fouling." Over time, carbon and other products of combustion can accumulate on the spark plug, including the surface of an insulator tip of the spark plug, which is typically positioned at or near a boundary of unmixed fuel, or at or near the center electrode tip. The products of combustion of a gasoline engine include particles of fuel additives such as Methylcyclopentadienyl Manganese Tricarbonyl (MMT) and Ferrocene, which are often added to gasoline as an octane enhancement. Normally, accumulated soot that is located near the spark point of the spark plug would be burned off from the heat of the generated spark. However, because the exposed surface of the insulator tip may not be located in or about a spark gap between the electrode tip and ground electrode, accumulated combustion soot may not be burned off. If significant amounts of these combustion products are accumulated, the spark may not properly form between the center and ground electrodes. The accumulated combustion soot creates an electrical short circuit such that the charge from the center electrode travels across the surface of the insulator and back to the outer metal shell instead of across the spark gap to the ground electrode. This process is called "fouling."

Accordingly, while existing spark plugs are suitable for their intended purposes, the need for improvement remains, particularly in providing a spark plug that is more resistant to fouling caused by the accumulation of combustion products on the insulator tip.

SUMMARY

According to one embodiment of the invention, an insulator for a spark plus is provided including an insulator tip. The insulator tip includes a feature extending radially inward from an exterior surface of the insulator tip. The feature additionally extends around the circumference of the insulator tip.

According to another embodiment of the invention, a spark plug for use in an internal combustion engine is provided including a center electrode. An insulator is disposed about the center electrode. An outer shell surrounds the insulator such that a tip of the insulator extends beyond an end portion of the outer shell. Disposed on the insulator tip is a feature extending radially inward toward the center electrode. The feature additionally extends around the circumference of the insulator tip.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Figure 1:
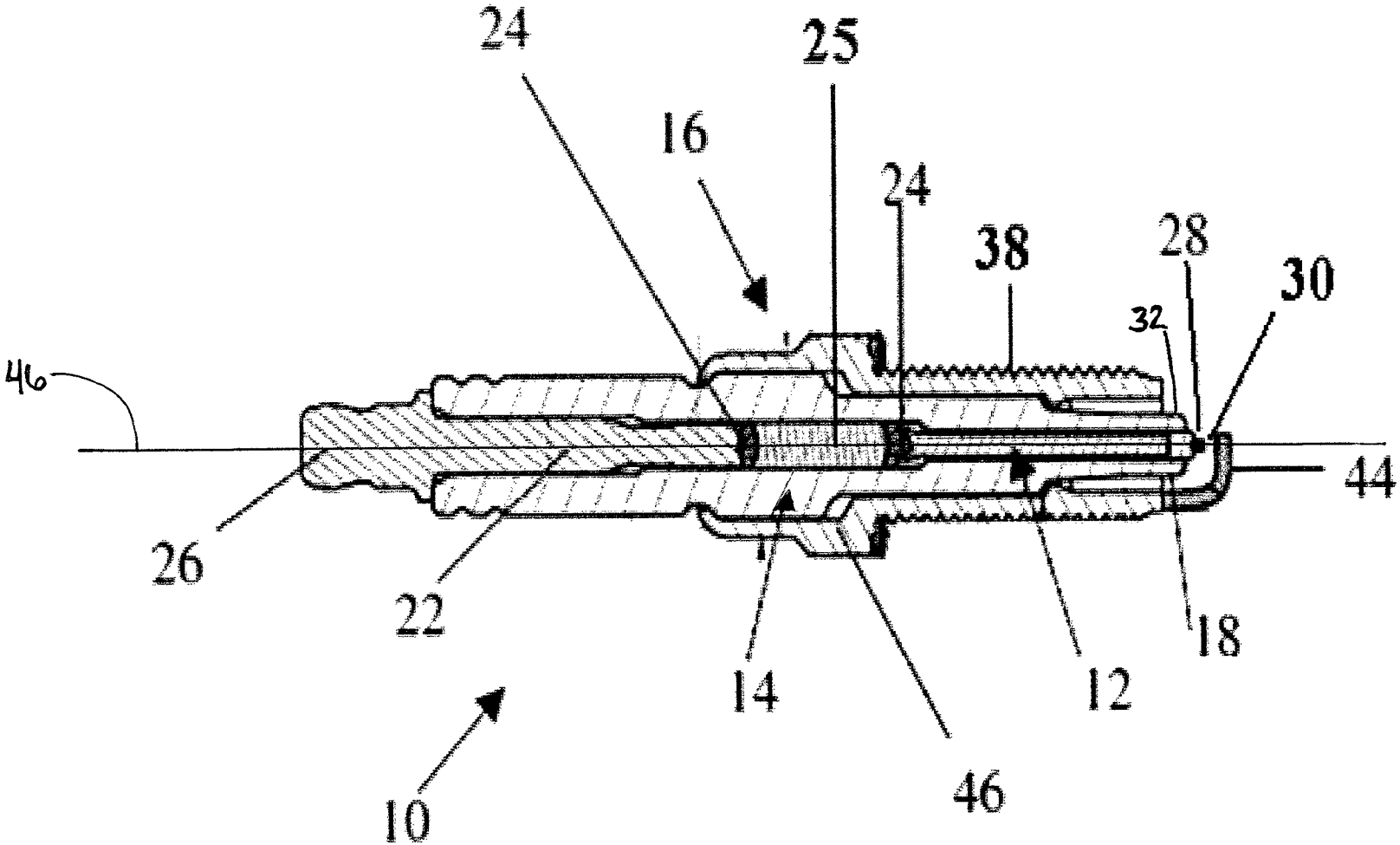
FIG. 1 is a cross-sectional view of a spark plug.

A fouling resistant spark plug 10 in accordance with the present disclosure includes an insulator 14 with an insulator tip 18 and a feature 50 that extends around at least a portion of the circumference of the insulator tip 18. In an illustrative embodiment, the circumferential feature 50 includes a groove 52 that is configured to prevent foulant or combustion particles from creating an electrode short across the feature 50. The groove 52 may be formed to include a substance 54 that can absorb combustion particles or prevents conductivity across the groove 52. The feature 50 may also include multiple grooves 52 that are spaced apart radially along the tip 18. Other embodiments of the feature 50 are also envisioned.

FIG. 1 illustrates an overall structure of the spark plug 10 designed for use in an internal combustion engine. The spark plug 10 protrudes into a combustion chamber (not shown) of the engine through a threaded bore provided in the engine head (not shown). The spark plug 10 includes a cylindrical center electrode 12 extending along the axial length of the spark plug 10, a ceramic or similarly comprised insulator 14 that concentrically surrounds the center electrode 12, and an outer shell 16 that concentrically surrounds the insulator 14.

Figure 2:
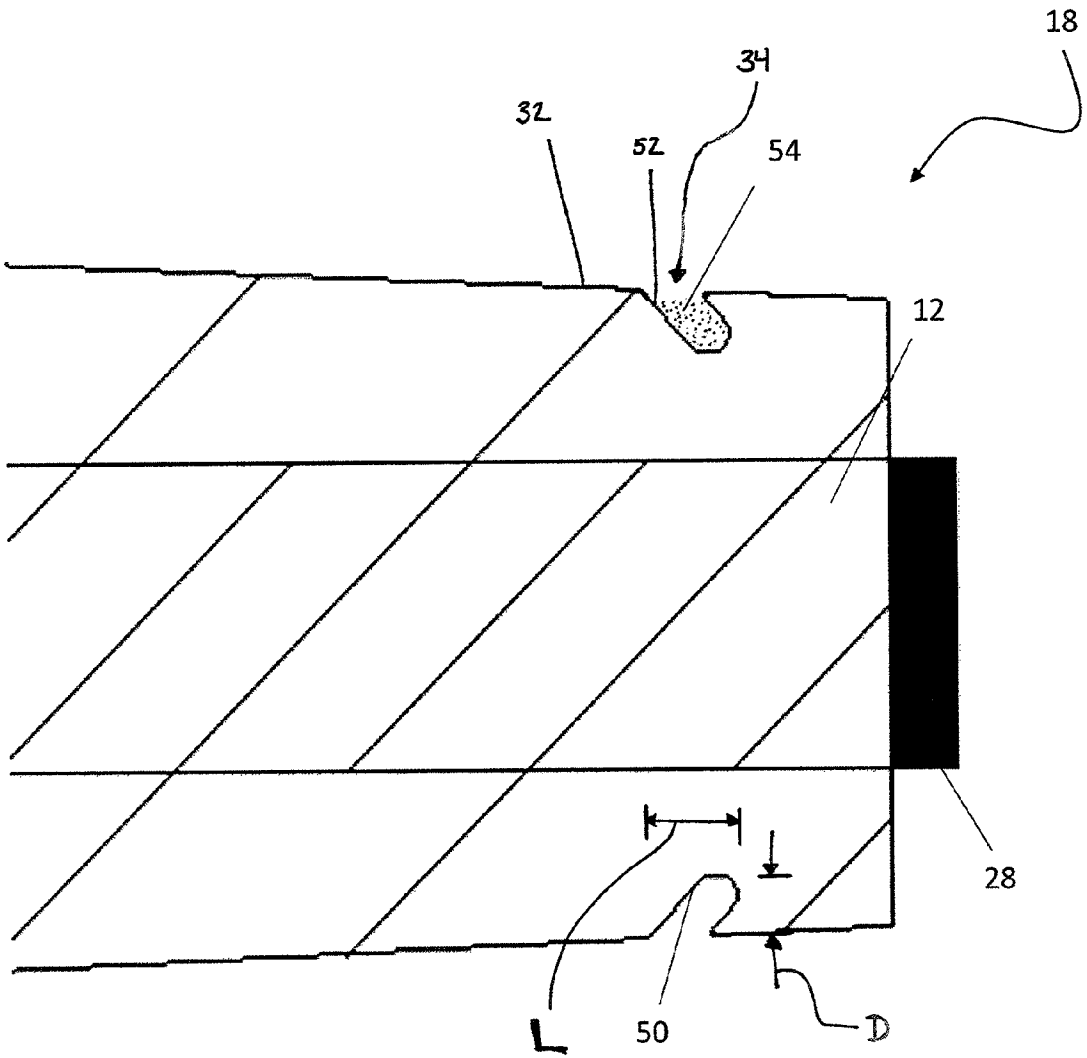
FIG. 2 is a cross-sectional view of a spark plug insulator tip in accordance with an illustrative embodiment.
Figure 3:
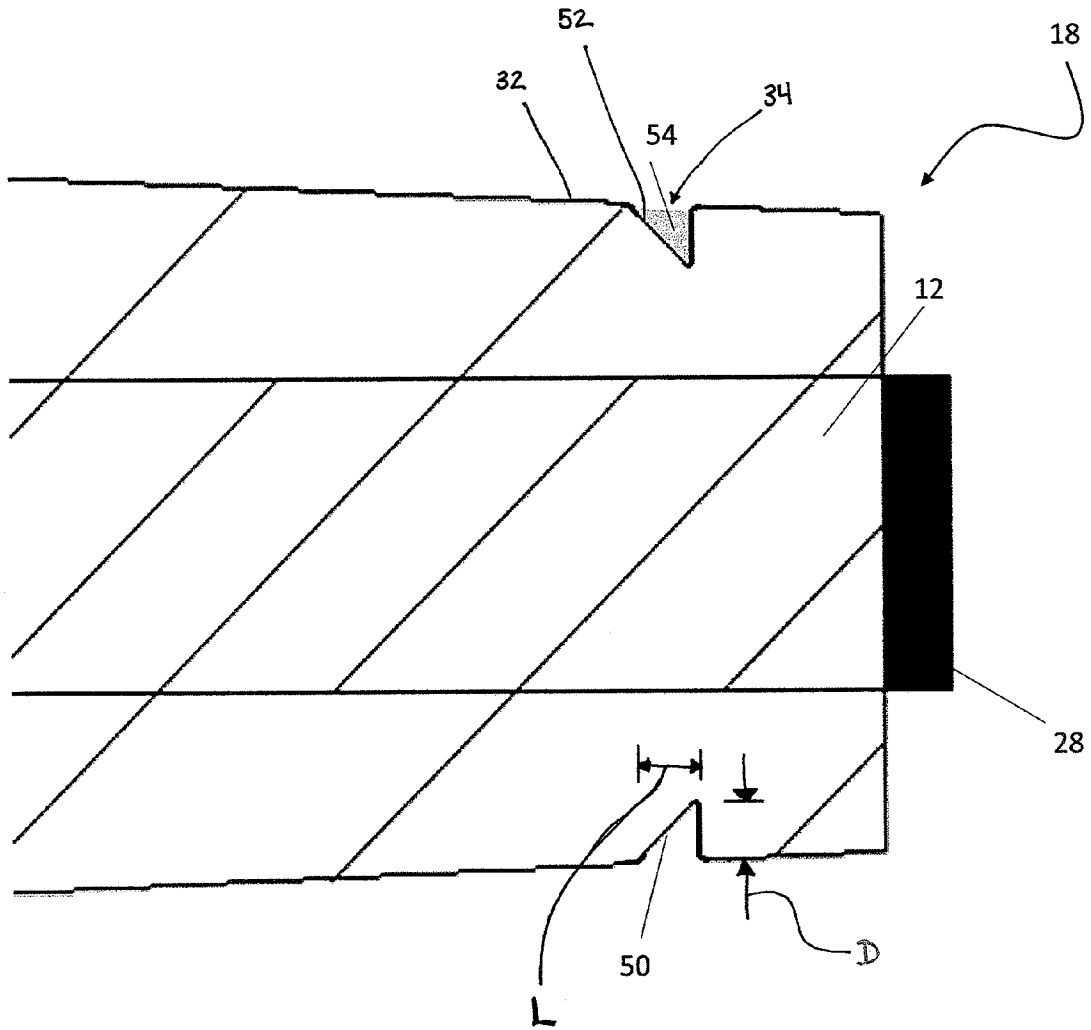
FIG. 3 is a cross-sectional view of a spark plug insulator tip in accordance with another illustrative embodiment.
Figure 4:
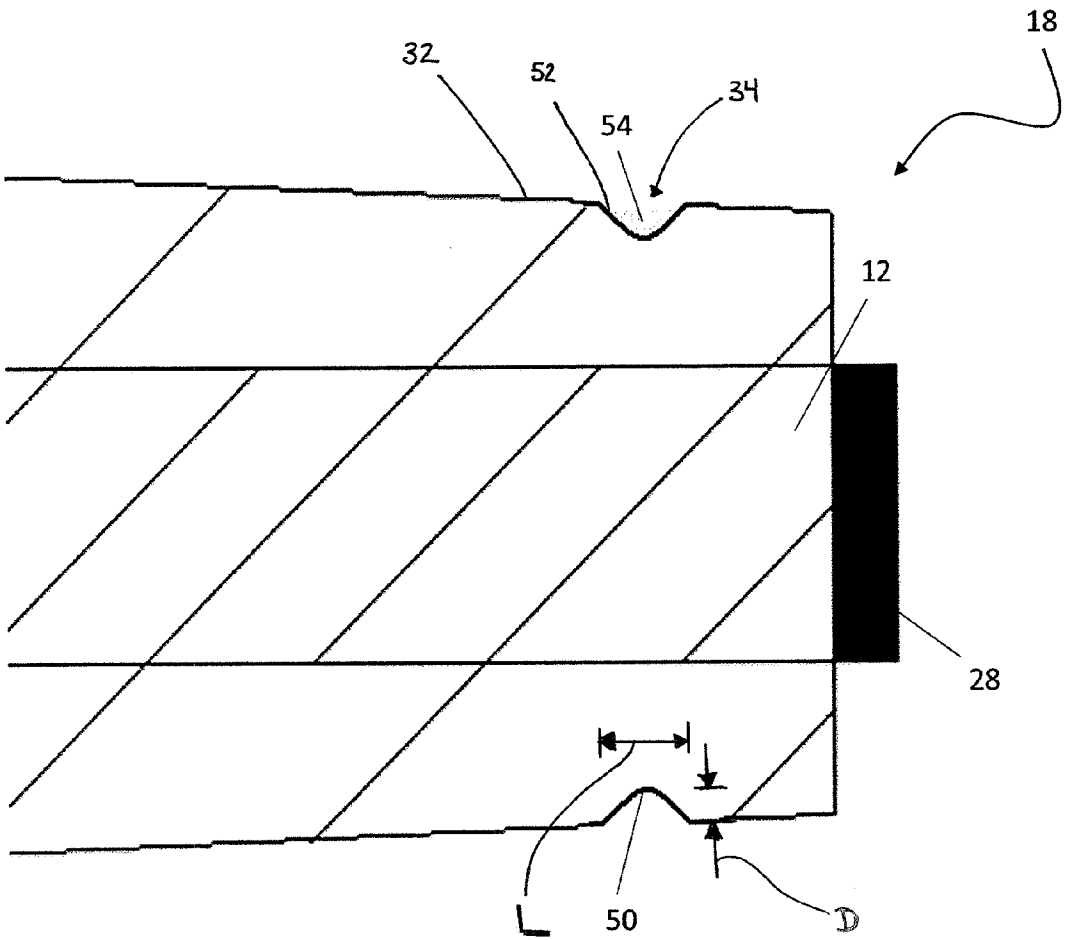
FIG. 4 is a cross-sectional view of a spark plug insulator tip in accordance with yet another illustrative embodiment.

In an illustrative embodiment, for example as seen in FIG. 1, a tip portion of the center electrode 12 may extend away from the insulator 14 at one end of the spark plug 10. The tip portion of the center electrode 12 may also end in alignment with a tip 18 of the insulator 14, as illustrated in FIGS. 2-4. Regardless, attached at the end of the center electrode 12 is a noble metal tip 28 made of materials such as gold, palladium, iridium, platinum, or some alloy thereof in any suitable form for enabling proper spark plug functioning. For example, a noble metal tip 28 consisting of a finewire may be added to the end of the center electrode 12 to improve resistance to wear and maintain a sparking gap between the center electrode 12 and a ground electrode 44 (see FIG. 1) coupled to the outer shell 16.

A illustrated in FIG. 1, the insulator 14 may have an elongated, substantially cylindrical body with multiple sections of varying diameters. The insulator tip 18 is the portion of the insulator that extends beyond the outer shell 16, and substantially surrounds the center electrode 12 near the noble metal tip 28. The outer shell 16 includes an integral external threaded portion 38 for engagement with an engine, as well as a hex nut (not shown) for tightening the spark plug 10 with a wrench when it is engaged in an engine. Connected to the outer shell 16 is the ground electrode 44, which extends away from the outer shell 16. The ground electrode 44 and the noble metal tip 28 of center electrode 12 define a spark plug gap 30. The ground electrode 44 is electrically connected with the threaded portion 38 of the outer shell 16 to form an electrical ground when the spark plug 10 is mounted in an engine cylinder.

Disposed on an exterior surface 32 of the insulator tip 18, as illustrated in FIG. 2, is a feature 50 extending radially inward from the exterior surface 32 of the insulator tip 18 toward the center electrode 12. The feature 50 provides the advantage of limiting the accumulation of combustion soot on the insulator tip 18. In illustrative embodiments, the feature 50 may be positioned near the end of the insulator tip 18 and adjacent the center electrode 12 and the noble metal tip 28. In one illustrative embodiment, the feature 50 is a recess or groove 52 that extends circumferentially around the exterior surface 32 of the insulator tip 18. The groove 52 forms an air gap 34 for an electrical charge conducting along the exterior surface 32 of the insulator 14. The longitudinal length of the groove 52 prevents combustion soot and other contaminants from creating an electrical short across the air gap 34 and fouling the spark plug 10. The inward depth of the groove 52 determines the amount of foulant that can enter the groove 52 and become trapped. The depth of the feature 50 prevents foulant particles from accumulating to create a conductive surface through which an electrical charge could travel. In one illustrative embodiment, the feature 50 may not be continuous and, instead, may include multiple grooves 52 along a single annular path about the exterior surface 32 of the insulator tip 18. In other illustrative, embodiments, multiple continuous or discontinuous grooves 52 may be formed in the exterior surface 32 of the insulator tip 18 and spaced along a longitudinal axis 46 of the spark plug 10.

The feature 50 of the present disclosure can be in multiple forms. As illustrated in FIGS. 2-4, the shape of the feature 50 may include any geometric variation having a length L and a depth D that extend for more than a surface distance that an electrical charge would have to traverse to create an electrical short. As illustrated in FIG. 2, in one illustrative embodiment, the feature 50 is a rounded, asymmetrical groove 52, angled toward the center electrode 12 and the noble metal tip 28 to form a pair of parallel conical surfaces connected by a semicircular surface. In another illustrative embodiment, as illustrated in FIG. 3, the feature 50 is a chamfered groove 52. The chamfered groove 52 may include a first conical surface angled towards the center electrode 12 and the noble metal tip 28. In another illustrative embodiment, as seen in FIG. 4, the groove 52 may be a symmetrical shape with two opposite, mirror-image surfaces angled towards each other.

In illustrative embodiments, a substance 54 may be disposed within at least a portion of the feature 50. The substance 54 chosen may be such that the capillary forces of the substance 54 hold the substance 54 in position in the feature 50, as illustrated in FIGS. 2-4. In one illustrative embodiment, the substance 54 may be an inorganic fluid or glaze that absorbs at least a portion of the combustion particles that it contacts. Additionally, the substance 54 may be either non-conductive, or may not exceed a desired conductivity level such that a charge traveling across the exterior surface 32 of the insulator 14 would not be able to conduct through the substance 54 to outer shell 16.

In the present disclosure, the spark plug 10 is configured to be utilized in an automobile engine that supplies electrical current to the spark plug 10 to create the spark. Specifically, one end of the center electrode 12 is electrically connected to a terminal stud 22 through an electrically conductive glass seal 24. In alternate embodiments, an additional resistor element 25 may be attached to the glass seal 24. As is known in the related arts, the terminal stud 22 may be made from steel or a steel based alloy material with a nickel plated finish. The terminal stud 22 further connects to a terminal nut 26 that protrudes from the insulator and attaches to an ignition cable (not shown) that supplies electrical current to the spark plug 10 when connected.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An insulator for a spark plug comprising:

an insulator tip; and, a circumferential feature extending radially inward from an exterior surface of the insulator tip, wherein the circumferential feature is a groove that has a diameter that is less than a diameter of the exterior surface of the insulator tip.

2. The insulator according to claim 1, wherein the groove is a continuous annular groove formed about an entire circumference of the insulator tip.

3. The insulator according to claim 1, wherein the groove is a discontinuous groove formed in a circumference of the insulator tip.

4. The insulator according to claim 2, wherein the groove forms a pair of parallel conical surfaces connected by a semicircular surface.

5. The insulator according to claim 1, wherein a longitudinal length of the groove prevents foulant particles from creating an electrical short across the groove.

6. The insulator according to claim 1, wherein an inward depth of the groove prevents foulant particles from accumulating to create a conductive surface through which an electrical charge could travel.

7. The insulator according to claim 1, further comprising a substance located within the groove.

8. The insulator according to claim 7, wherein the substance is a fluid or glaze capable of absorbing combustion particles.

9. The insulator according to claim 7, wherein the substance is nonconductive or does not exceed a maximum conductivity.

10. A spark plug comprising:

a center electrode;

an insulator disposed about the center electrode;

an outer shell surrounding the insulator; and wherein the insulator includes a tip that extends beyond an end portion of the outer shell and wherein a circumferential feature is formed in an exterior surface of the insulator tip and is a groove in the insulator tip.

11. The spark plug according to claim 10, wherein the groove is a continuous annular groove formed about an entire circumference of the insulator tip.

12. The insulator according to claim 10, wherein the groove is a discontinuous groove formed in a circumference of the insulator tip.

13. The spark plug according to claim 11, wherein the groove forms a pair of parallel conical surfaces connected by a semi-circular surface.

14. The spark plug according to claim 10, wherein a longitudinal length of the groove prevents foulant particles from creating an electrical short across the groove.

15. The spark plug according to claim 10, wherein an inward depth of the groove prevents foulant particles from accumulating to create a conductive surface.

16. The spark plug according to claim 10, further comprising a substance located within the groove.

17. The spark plug according to claim 16, wherein the substance is a fluid or glaze capable of absorbing combustion particles.

18. The insulator according to claim 16, wherein the substance is nonconductive or does not exceed a maximum conductivity.

19. The insulator according to claim 1, wherein the groove has a triangular cross-sectional shape.

20. The insulator according to claim 1, wherein the groove has a rounded cross-sectional shape.

* * * * *